US008075015B2

(12) United States Patent
Fumagalli

(10) Patent No.: US 8,075,015 B2
(45) Date of Patent: Dec. 13, 2011

(54) RETAINMENT STRAP FOR BINDINGS PARTICULARLY FOR SNOWBOARDS

(75) Inventor: Martino Fumagalli, Colico (IT)

(73) Assignee: Core S.R.L., Delebio (IT)

( * ) Notice: Subject to any disclaimer, the term of this patent is extended or adjusted under 35 U.S.C. 154(b) by 967 days.

(21) Appl. No.: 11/988,724

(22) PCT Filed: Jun. 6, 2006

(86) PCT No.: PCT/EP2006/062921
§ 371 (c)(1),
(2), (4) Date: Jan. 14, 2008

(87) PCT Pub. No.: WO2007/009840
PCT Pub. Date: Jan. 25, 2007

(65) Prior Publication Data

US 2010/0253045 A1 Oct. 7, 2010

(30) Foreign Application Priority Data

Jul. 22, 2005 (IT) ..... MI2005A1428

(51) Int. Cl.
*A63C 9/00* (2006.01)

(52) U.S. Cl. ..... 280/619; 280/623; 280/14.22

(58) Field of Classification Search ..... 280/623, 280/607, 14.22, 14.21, 636, 624, 618, 619, 280/634, 11.3
See application file for complete search history.

(56) References Cited

U.S. PATENT DOCUMENTS

| | | | | |
|---|---|---|---|---|
| 4,796,337 | A * | 1/1989 | Marxer | 24/68 SK |
| 5,758,895 | A * | 6/1998 | Bumgarner | 280/607 |
| 6,056,300 | A * | 5/2000 | Carpenter et al. | 280/14.22 |
| 6,206,403 | B1 * | 3/2001 | Black et al. | 280/618 |
| 6,250,651 | B1 * | 6/2001 | Reuss et al. | 280/14.21 |
| 6,293,577 | B1 * | 9/2001 | Shields | 280/617 |
| 6,669,211 | B2 * | 12/2003 | Gonthier | 280/11.3 |
| 6,739,615 | B1 * | 5/2004 | Maravetz et al. | 280/624 |
| 6,945,543 | B2 * | 9/2005 | De Bortoli et al. | 280/14.21 |
| 7,036,830 | B2 * | 5/2006 | Gonthier | 280/14.21 |
| 7,427,079 | B2 * | 9/2008 | Piva | 280/623 |
| 2001/0010418 | A1 * | 8/2001 | Gonthier | 280/11.3 |
| 2002/0101044 | A1 | 8/2002 | Gonthier | |
| 2005/0046150 | A1 | 3/2005 | Couderc | |
| 2005/0280248 | A1 | 12/2005 | Jean | |

FOREIGN PATENT DOCUMENTS

EP 0 852 958 A 7/1998

* cited by examiner

*Primary Examiner* — Hau Phan

(74) *Attorney, Agent, or Firm* — Modiano & Partners; Albert Josif; Daniel O'Byrne

(57) ABSTRACT

The present invention relates to a retainment strap for bindings particularly for snowboards that comprises an actuation lever fixable to a tie-rod coupleable to one side of a binding and engageable with a toothed strip fixable to the other side of the binding, the retainment strap further comprising an external sheath fixable to the base of the actuation lever and having a passage channel for the tie-rod. The tie-rod is provided with a plurality of selectively adjustable fixing zones for the base. Symbols that are viewable from a small window in the sheath are provided on the tie-rod in a manner to indicate outwardly the length adjustment for the retainment strap. The tie-rod is provided with a longitudinal slot for rendering the tie-rod more flexible.

5 Claims, 2 Drawing Sheets

RETAINMENT STRAP FOR BINDINGS PARTICULARLY FOR SNOWBOARDS

The present invention relates to a retainment strap for bindings particularly for snowboards.

BACKGROUND OF THE INVENTION

As it is known, there are already present on the market various types of bindings for snowboards that, in general lines, have a strap that is arranged at the foot instep of the user.

EP-0 852 958 discloses a snowboard binding in which the closing strap is constituted, on one side, by a toothed strip which is connected to a ratchet lever or similar element which is supported on another portion of strap that is provided with two distinct pieces that allow to modify the useful length due to the fact that a portion is provided with a plurality of mutually spaced holes that are employed in a manner to be able to modify the effective length.

This embodiment, besides being undoubtedly complex from a manufacturing point of view, has not demonstrated itself advantageous concerning the optimal distribution of the forces and, moreover, renders difficult the application of covering elements that render the strap itself more comfortable for the foot of the user.

SUMMARY OF THE INVENTION

The aim of the present invention is to solve the above described problem, by providing a retainment strap for bindings particularly for snowboards, in which the manufacturing form is drastically simplified, while also being able to offer an optimum length adjustment of the strap.

Within this aim, an object of the invention is to provide a retainment strap that is particularly comfortable for the user, giving the possibility to uniformly distribute the forces without creating any localized stresses.

Another object of the present invention is to provide a retainment strap that, due to its particular constructive characteristics, is capable of giving the widest guarantees of reliability and safety in use.

A not least object of the present invention is to provide a retainment strap that is easily obtainable starting from components and materials easily found in commerce and that, moreover, is competitive from a purely economic point of view.

This aim and these and other objects which will become better apparent hereinafter, are achieved by a retainment strap for bindings particularly for snowboards, according to the invention, comprising an actuation lever fixable to a tie-rod coupled to one side of a binding and engageable with a toothed strip fixable to the other side of the binding, characterized in that it comprises an external sheath fixable to the base of said actuation lever and having a passage channel of said tie-rod, said tie-rod being provided with a plurality of selectively adjustable fixing zones for said base.

BRIEF DESCRIPTION OF THE DRAWINGS

Further characteristics and advantages of the invention will become better apparent from the following detailed description of a preferred but not exclusive embodiment of a retainment strap for bindings particularly for snowboards, illustrated by way of non-limiting example in the accompanying drawings, wherein.

DESCRIPTION OF THE PREFERRED EMBODIMENTS

Figure 1:
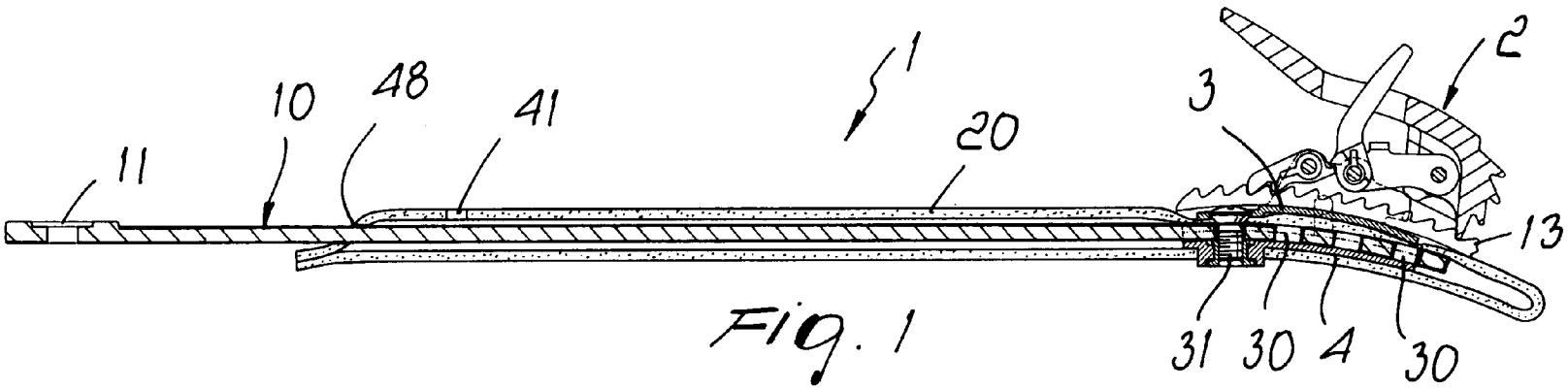
FIG. 1 is a schematic longitudinal sectional view of the retainment strap according to the invention.

With reference to the figures, a retainment strap for bindings particularly for snowboards, according to the invention, which is referenced as a whole by the reference numeral 1, comprises an actuation lever 2, advantageously of the ratchet type, that is connected at one end of a tie-rod 10 which, at one other end 11, is laterally fixable to a binding, indicated generally by 12.

The retainment strap further comprises a toothed strip 13 that is connected to the other side of the binding 12, which is engageable by the actuation lever 2.

The particularity of the invention is constituted by the fact that there is provided an external sheath 20 that has at its inside a channel 21, in which the tie-rod 10 passes.

The actuation lever is fixable to the sheath 20 and it is provided with fixing means for engaging with the tie-rod 10 that is advantageously provided with a plurality of fixing zones for the base 3 that supports the actuation lever 2.

More in detail, on the tie-rod 10 the fixing zones are obtained by means of a plurality of through holes 30 arranged at the fixing end to the sheath 20 in which there is selectively engaged a fixing bolt 31 or similar element that provides the connection of the base 3 to the counterbase 4 that is positionable on the opposite side in order to delimit the passage zone of the tie-rod 10.

With the described arrangement therefore the actuation element remains connected together with one end of the external sheath 20 and it is fixable in the pre-selected hole of the tie-rod 10, in a manner such as to adjust its useful length.

There is to be added to the above that advantageously on the tie-rod 10 there are provided symbols, indicated by 40, which may, for example, be constituted by numbers that are viewable from a small window 41 provided on the sheath 20, in a manner to indicate outwardly the length adjustment that has been pre-chosen for the retainment strap.

In its mid-portion the tie-rod 10 is provided with a longitudinal slot 45 that has the function of rendering the tie-rod more flexible, facilitating its coupling with the body of the foot.

Figure 2:
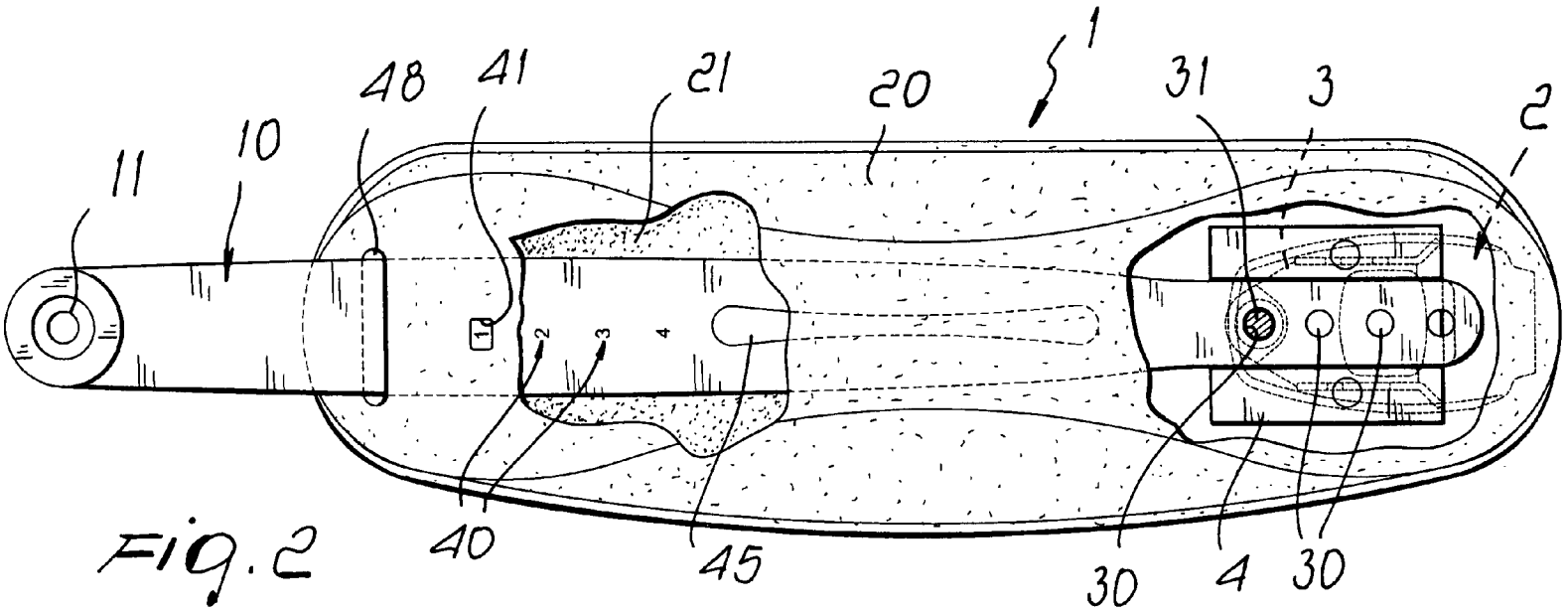
FIG. 2 is partially cut-out top view of the retainment strap.
Figure 4:
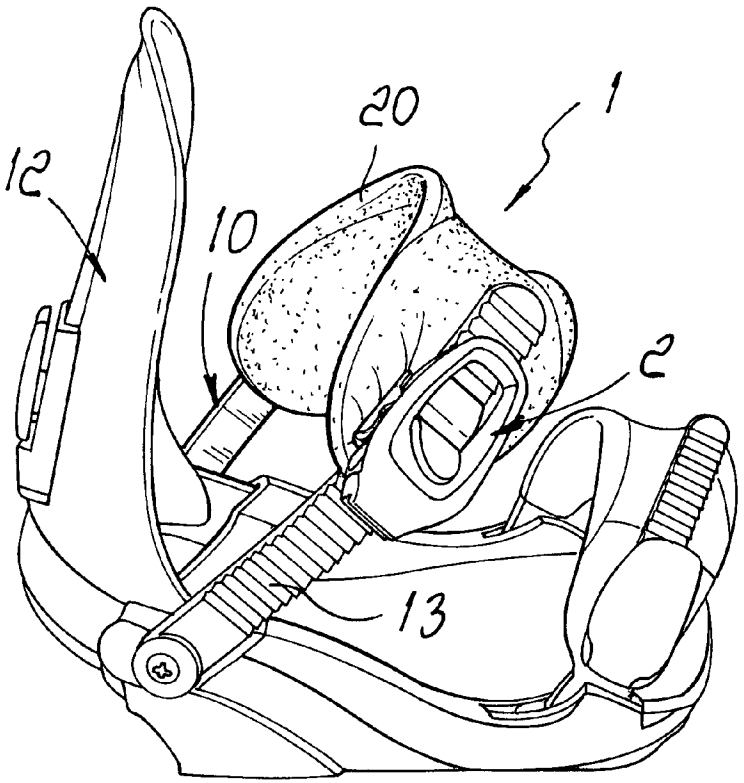
FIG. 4 a perspective view from the other side of the retainment strap integrated in a snowboard binding.
Figure 3:
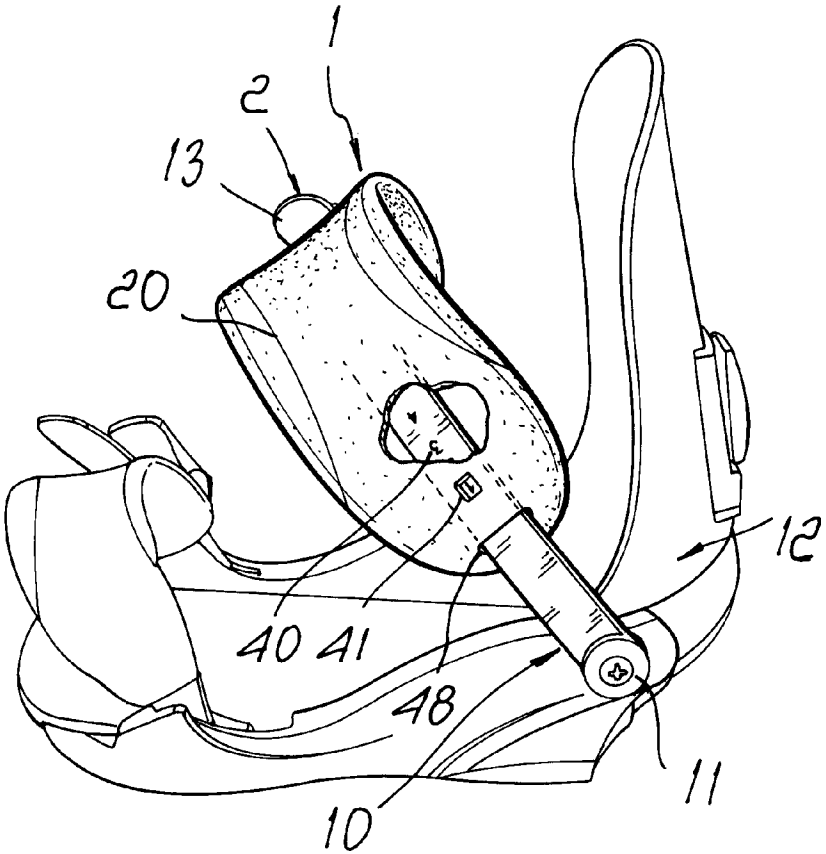
FIG. 3 a perspective view from one side of the retainment strap integrated in a snowboard binding.

The tie-rod 10, at the end facing the fixing part 11 of the tie-rod 10, exits towards the outside of the sheath 20 by means of a transverse slot 48, as shown in FIG. 2.

From the above description it is seen therefore how the invention achieves the intended aim and objects and in particular the fact is highlighted that there is provided a retainment strap which is particularly simple from a structural point of view, since it is constituted solely by the tie-rod 10 arranged inside an external sheath that is connected together to the actuation lever 2, in a manner to be able to always correctly position it on the foot instep of the user.

The invention thus conceived is susceptible to numerous modifications and variations all of which fall within the scope of the appended claims.

Moreover all of the details may be substituted by other technically equivalent elements.

In practice, the materials employed as well as the dimension and the contingent shapes may be any according to requirements.

The disclosures in Italian Patent Application No. MI2005A001428 from which this application claims priority are incorporated herein by reference.

The invention claimed is:

1. A retainment strap for bindings particularly for snowboards, comprising an actuation lever fixable to a tie-rod coupled to one side of a binding and engageable with a toothed strip fixable to another side of the binding, further comprising an external sheath fixable to a base of said actuation lever and having a passage channel for said tie-rod, said tie-rod being provided with a plurality of selectively adjustable fixing zones for said base, wherein said fixing zones comprise a plurality of through holes provided on said tie-rod and wherein fixing means of said tie-rod to said base of the actuation lever comprise a single fixing bolt and a counter-base coupleable to said base by means of said fixing bolt.

2. The retainment strap of claim 1, wherein said through holes forming said fixing zones are positioned at the fixing end of said external sheath to said tie-rod.

3. The retainment strap of claim 1, comprising, on said tie-rod, symbols viewable from a small window provided on said sheath for indicating the length adjustment of said retainment strap.

4. The retainment strap of claim 1, comprising a longitudinal slot provided at a mid-portion of said tie-rod.

5. The retainment strap of claim 1, comprising a transverse slot on said sheath for external exit of said tie-rod.

* * * * *